US006200051B1

(12) United States Patent
Gueret

(10) Patent No.: US 6,200,051 B1
(45) Date of Patent: Mar. 13, 2001

(54) PORTABLE PACKAGING UNIT FOR A PRODUCT SUCH AS MASCARA

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/453,577

(22) Filed: Dec. 3, 1999

Related U.S. Application Data

(62) Division of application No. 08/705,719, filed on Aug. 30, 1996, now Pat. No. 6,062,757.

(30) Foreign Application Priority Data

Aug. 30, 1995 (FR) ..... 95-10231

(51) Int. Cl.[7] ..... A46B 11/00
(52) U.S. Cl. ..... 401/122; 401/126; 401/129
(58) Field of Search ..... 401/122, 126, 401/127, 129, 119, 118

(56) References Cited

U.S. PATENT DOCUMENTS

| | | | | |
|---|---|---|---|---|
| 2,736,050 | * | 2/1956 | Lee | 401/126 |
| 5,307,847 | * | 5/1994 | Pavenick et al. | 401/127 |
| 5,391,011 | * | 2/1995 | Gueret | 401/126 |
| 5,743,279 | | 4/1998 | Gueret . | |
| 6,026,824 | | 2/2000 | Gueret . | |

* cited by examiner

*Primary Examiner*—David J. Walczak
(74) *Attorney, Agent, or Firm*—Oblon, Spivak, McClelland, Maier & Neustadt, P.C.

(57) ABSTRACT

A portable and possibly rechargeable packaging unit for a product such as mascara includes an applicator and a reservoir provided with at least one wiper. The applicator has a handle and at least one tuft of bristles implanted parallel to the median plane of this handle, these bristles being of a specific shape and length and capable of applying mascara to keratinous fibers, and in particular to eyelashes. The reservoir has a length substantially equal to that of the bristles of the applicator.

8 Claims, 2 Drawing Sheets

PORTABLE PACKAGING UNIT FOR A PRODUCT SUCH AS MASCARA

This application is a Divisional of application Ser. No. 08/705,719 filed on Aug. 30, 1996, now U.S. Pat. No. 6,062,757.

BACKGROUND OF THE INVENTION

1. Field of the invention

The invention concerns a portable and possibly rechargeable packaging unit for a liquid to pasty product such as mascara, comprising an applicator and a reservoir provided with at least one wiper. More precisely, the applicator comprises a handle supporting at least one tuft of bristles, these bristles being of a specific shape and length and capable of applying mascara to keratinous fibers, and eyelashes in particular.

2. Description of the Related Art

Many devices for the application and for the packaging of mascara have been proposed which generally comprise a rigid tubular body, open at one end, containing the make-up product, and an applicator capable of being accommodated in this body and provided with a stem ending in a brush. A wiper accommodated in the body ensures that the brush and/or the stem are wiped when the applicator is withdrawn from the body. However, one of the drawbacks encountered when the known devices for the application and the packaging are used, is that the applicator behaves like a piston during its displacement in the rigid body, thus creating a disagreeable sucking noise by the sudden return of the interior of the body to atmospheric pressure.

When the make-up product is fluid, the wiper comprises a constricted portion so as to effect the wiping of the stem of the brush. Thus there is prevented from being left on the stem a quantity of the product which could, during the use of the brush, come to flow onto the stopper of the applicator and thus foul the thread of the applicator which is intended for fixing the stopper on the body. This constricted portion contributes to increasing the intensity of the emitted sucking noise. Moreover, when the applicator is being withdrawn, a quantity of the mascara coming from the wiping of the stem is accumulated at the periphery of the constricted portion of the wiper and forms an accumulation which is splattered by a Venturi effect towards the end of the brush when the air suddenly enters into the rigid body. This splattering of the mascara at the end of the brush understandably constitutes a nuisance as far as the user is concerned, and causes a loss of the product.

Another drawback presented by the known application and packaging devices is the shearing of the formula of the mascara during the wiping of the brush in the way described above. Indeed, in such devices, the wiping breaks the formula of the mascara since it is effected perpendicularly to the bristles of the brush; the mascara is subjected to a variation in viscosity; it may form clumps producing a poor smoothing of the eyelashes. This is, in particular, the case with the mascaras having a high pigmentary charge. The existence of this phenomenon necessitates the use of compositions that are not susceptible to shear, and limits the choice of mascara compositions that can be used.

Finally, these mascara application and packaging devices have the drawback that they are large in size and their contents frequently dry out before being entirely used up. It is therefore impracticable for the same user to have available several mascara products, for example of different colors. Moreover, the known rechargeable type of device is also large in size and the product dries before being entirely used up, losing its making-up properties.

There thus remains the need for a portable and rechargeable mascara packaging unit in which all the product could be used up to the end without the risk of drying out, and while the product retains all its making-up properties.

SUMMARY OF THE INVENTION

It is therefore an object of the invention to provide a portable and rechargeable mascara packaging unit in which all the product could be used up to the end without the risk of drying out, and while the product retains all its making-up properties.

The present invention therefore provides a new portable packaging unit for a liquid to pasty product such as mascara, comprising a first reservoir for a product to be stored and dispensed, and an applicator provided with a flat, substantially planar handle and with a bristled part mounted on this handle, the applicator being capable of closing the first reservoir. The length of the first reservoir is substantially equal to that of the bristled part and the bristled part is directly fixed on the handle.

The product which is carried by the packaging unit of the invention can be any liquid to pasty product, like pigments and/or fillers comprising fluids, and in particular hair dye or mascara. The keratinous fibers can be eye lashes eyebrows, hair or bristles.

Advantageously, the bristled part has at least one tuft of bristles implanted parallel to the plane of the handle of the applicator and the width of the free end of the tuft of bristles, measured along a first direction parallel to this plane, is at least equal to one quarter of the arc of the eyelashes, the bristles being capable of applying mascara to the keratinous fibers along a preferably longitudinal axis of the fibre. That is, its width is at least a quarter of the arc formed by the eyelashes of the eye having the mascara applied thereto.

Advantageously, the unit comprises means for creating low pressure inside the first reservoir when the applicator is being withdrawn from this first reservoir with a view to loading the bristles with product to be dispensed. In particular, it may have a wiper which may be fixed in the first reservoir and which is matched to the shape of the bristled part so as to wipe the bristles parallel to their longitudinal axis, thus avoiding the above mentioned shearing. This special configuration also makes it possible to avoid the sucking noise when the applicator is being withdrawn. The first reservoir may also comprise a flexible pouch containing the product to be dispensed. In this special case, the wiper may be fixed at the head of the flexible pouch. This ensures a better loading of the bristles with mascara. Indeed, the withdrawal of the applicator produces a low pressure inside the flexible pouch which applies the walls of this pouch to the bristles of the applicator, and therefore loads the bristles with mascara.

This packaging unit is extra flat and thus has the advantage of not taking up much space, of being easily portable, and of being rechargeable. Indeed, when the contents of the flexible pouch have been completely used up, it may be replaced by another similar pouch that is, for example, heat-sealed. Moreover, the handle may advantageously form a secondary reservoir. It is thus possible to remove the first reservoir and to replace it by the secondary reservoir and vice versa.

Moreover, this applicator is washable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
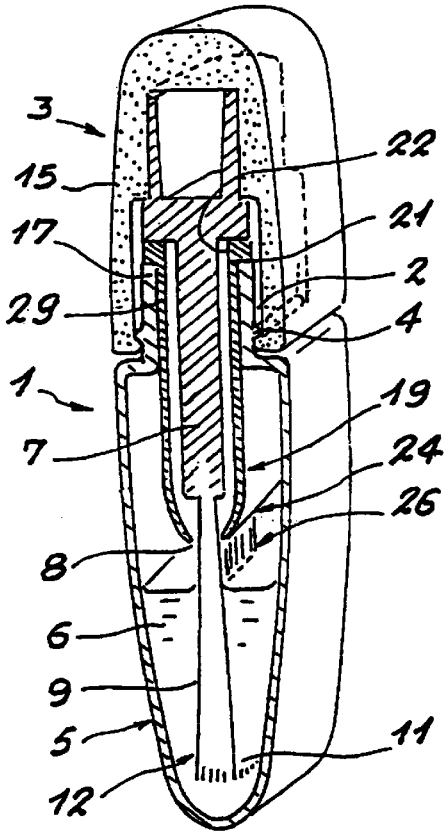
FIG. 1 is a sectional perspective view of the packaging unit in accordance with the invention.

In the embodiment illustrated in FIG. 1, the packaging unit 1 of the invention comprises an applicator 3 and a first reservoir 5 for a product, in this case mascara. As compared to the prior art, this unit is extra flat. Thus, the width of the packaging unit, measured along the straight line which is perpendicular to the plane of the handle, preferably ranges from 4 mm to 12 mm. The applicator 3 is provided with a flat handle 7 and an extra flat part 9 with bristles directly fixed to this handle and extending parallel to the plane of the handle. The part 9 with bristles is constituted by several tufts 12 of aligned bristles, the bristles 11 having lengths, shapes, diameters, cross-sections and other characteristics which may be preselected according to the loading, low or high, which is intended to be applied to the keratinous fibers. At least one portion of the bristled part 9 dips into the mascara. A portion of the handle 7 may dip into the first reservoir 5. The bristled part 9 has an overall effective length to ensure an optimum loading of the keratinous fibers and in particular of the eyelashes. This length is substantially equal to that of the first reservoir 5. In particular, this length ranges from 4 to 60 mm, preferably from 5 to 40 mm.

The handle 7 is mounted on a cap 15 which functions as a lid and which is capable of being catch engaged (groove 2-bead 4) on the first reservoir 5. This first reservoir 5 has a neck 17 whose internal wall 29 is provided with a wiper 19, one end 22 of which, situated opposite the cap 15, is fixed on this neck 17.

In another embodiment of the invention, the end 22 can bear on the neck 17 of the first reservoir 5. The handle 7 has a sealing system at the level of the end 22 of the wiper. This may be the gasket 21 or a washer bearing on a flange. The wiper 19 has on the opposite side to its fixed end 22, a free end 24 wherein an opening 8 is arranged for the passing of the bristled part. This opening is of an oblong shape or has the shape of a flattened ellipse and its major dimension is perpendicular to the part with bristles, so as to smooth the bristles along their axis when the applicator is being withdrawn. The wiper is capable of wiping the bristled part along the axis of the bristles. It may comprise, at its end 24, another sealing system that can be used on its own or together with the sealing system 21 of the handle. The wiper may be made of a rigid or semi-rigid material, preferably chosen from elastomers or thermoplastic materials.

In the embodiment of this FIG. 1 the packaging unit is closed, and the opening 8 of the wiper is situated opposite the fixed end 26 of the bristled part. It is possible to position this opening 8 opposite the handle 7. In this case, the wiper must be shaped according to the shape of the handle to ensure the wiping of the handle and of the bristled part 9, always in the longitudinal direction of the bristles 11, when the applicator is withdrawn. Preferably, the fixed end 26 of the bristled part is situated in the vicinity of the opening 8 of the wiper.

This packaging unit may have an overall length which is 3 to 6 times smaller than that of the conventional packaging units. Advantageously, the overall length of the packaging unit in accordance with the invention ranges from 1 to 10 cm, and preferably from 1 to 5 cm.

In practice, when the user withdraws the applicator 3 from the reservoir 5, the wiping of the bristles 11 is effected at the level of the opening 8 of the end 24 of the wiper 19. By being effected parallel to the longitudinal axis of the bristles, this wiping does not shear the formula of the mascara. Such a packaging unit thus makes it possible to use compositions that are generally susceptible to the shear phenomenon, and makes it possible to use new mascara formulations.

Figure 2:
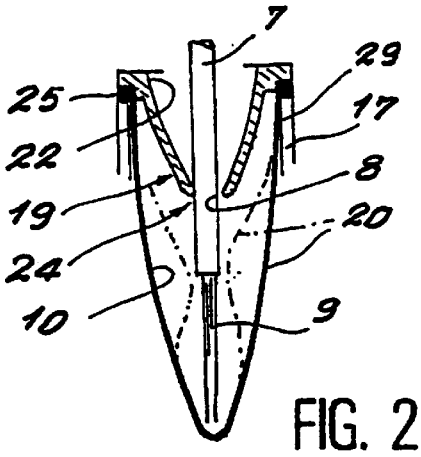
FIG. 2 is a sectional view of the flexible pouch contained in the first reservoir before and after the applicator has been withdrawn.

According to a preferred embodiment of the invention, the mascara may be contained in a flexible pouch 20, shown in FIG. 2, having an opening 25. The opening 25 has a cross-section equal to the internal cross-section of the neck 17 of the reservoir, the edge of this opening 25 being positioned between (i) the internal wall 29 of the neck 17 and (ii) the end 22 of the wiper 19. The end 24 of the wiper 19 is situated inside the flexible pouch 20. The dot-dash lines show the position of the flexible pouch 20 at the start of withdrawal of the applicator. Due to the low pressure, the walls 10 of the flexible pouch are then drawn in and adhere along the bristled part 9 which is thus loaded with mascara spread over the bristled part 9 by the internal walls 10 of the flexible pouch 20.

Figure 3:
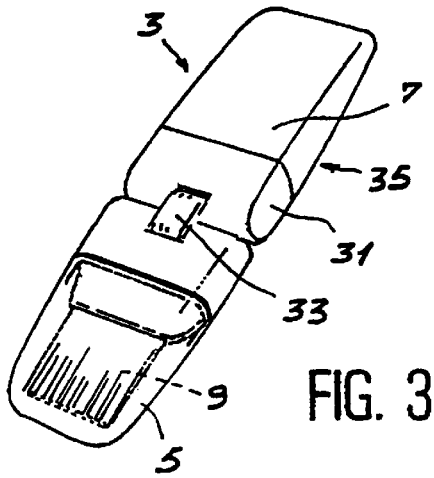
FIG. 3 shows another embodiment of the invention, wherein the handle includes a mascara refill.

The packaging unit of FIG. 3 is distinguished from that of FIG. 1 by the flexible handle 7 and a secondary reservoir 35 for mascara, performing the function of a refill and a cap 31. The handle 7 is here made of two parts articulated at a hinge 33. Such a flexible handle imparts greater softness and flexibility to the making-up.

The first reservoir 5 containing the bristled part 9, and the secondary reservoir 35, are disposed symmetrically relative to the hinge 33. By washing the unit and more particularly the bristled part 9, two different mascaras can be used in the two reservoirs 5 and 35. For instance it is possible to use a blue mascara and a black mascara.

The secondary mascara reservoir 35 as well as the first mascara reservoir 5 may each contain from 0.5 to 10 $cm^3$ of the product, preferably from 1 to 5 $cm^3$. This capacity may constitute half or a third of the conventional capacity of known mascara containers. This small size makes it possible to avoid drying of the product, which can be completely used up before drying out and can thus retain an ideal texture throughout its use.

Figure 4:
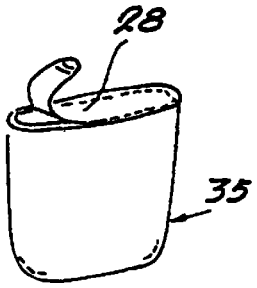
FIG. 4 is a perspective view of the refill of the unit shown in FIG. 3.

FIG. 4 shows the secondary reservoir 35 in perspective. It is identical with the first reservoir 5 and may replace it when the first reservoir is empty. With a view to preventing the mascara from flowing out and ensuring the proper preservation of the mascara, a tearable cover 28 is provided. A stopper or catch engaged on the reservoir 35 may also be used instead of this cover.

Figure 5:
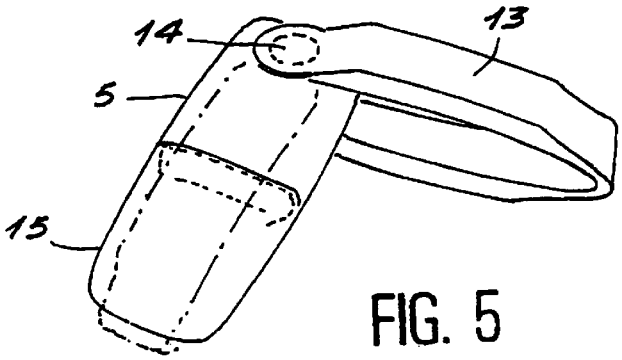
FIG. 5 shows a variant of the unit of FIG. 1 and having a special means for closing the packaging unit.

The packaging unit shown in FIG. 5 is distinguished from that of FIG. 1 by its closing system which is here a shackle 13. The applicator and the first reservoir are kept together by means of this shackle, one of whose ends 14 is joined to the first reservoir. In another embodiment of the invention (not shown) the end 14 of the shackle 13 may be joined to the cap 15.

Figure 6A:
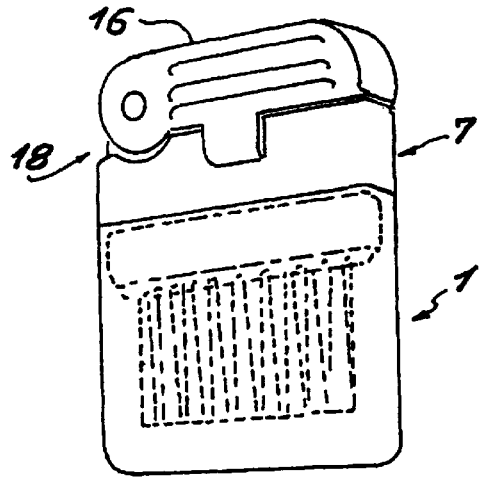
FIGS. 6*a* and 6*b* show variants of the unit of FIG. 1, wherein the handle includes a hinged part which can be opened and closed to allow the applicator to be gripped at the side.
Figure 6B:
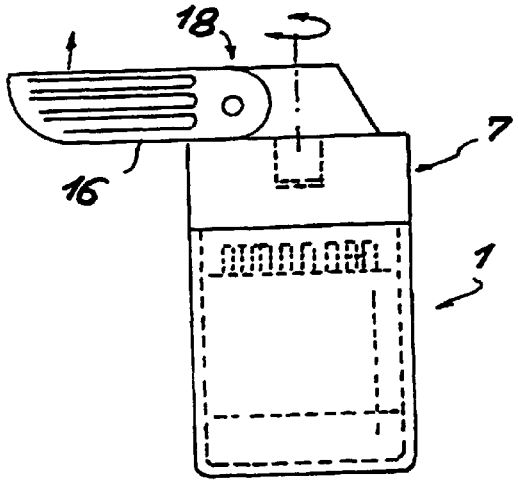

FIGS. 6*a* and 6*b* show a variant of the packaging unit 1 of FIG. 1 whose handle 7 comprises a part 16 articulated around hinge 18, allowing the applicator to be gripped at the side. In the open position, as shown in FIG. 6*b*, this part 16 thus forms an element for gripping the applicator at the side. FIG. 6*a* shows the applicator when the part 16 has been closed again.

Figure 7:
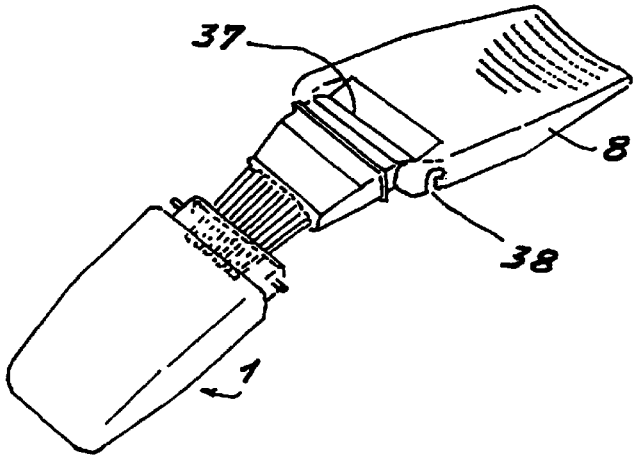
FIG. 7 is a perspective view of the packaging unit of the invention having an articulated handle.

The packaging unit of FIG. 7 has an articulated handle 8 with a hinge 37. The notch 38 holds the handle in an inclined position.

The packaging unit in accordance with the invention has the advantages that it is rechargeable and that it can be easily carried. Thanks to such a packaging unit, waste of the product, due to the excessive capacity of the reservoir of the known devices, is prevented.

Such a packaging unit is very easy to make: it can be made of any material generally used for the manufacture of cosmetic accessories. Since the applicator does not have a central metallic core, the packaging unit can be made solely from organic materials, and in particular solely of plastic materials, and can therefore be completely recyclable. obviously, numerous modifications and variations of the present invention are possible in light of the above teachings. It is therefore to be understood that the invention may be practiced otherwise than as specifically described herein.

What is claimed is:

1. A portable packaging unit for applying a liquid to pasty product onto keritanous fibers, comprising:

a first reservoir for a product to be stored and dispensed; and an applicator comprising a substantially planar handle made of two parts articulated at a hinge, and a bristled part directly fixed on said handle, said applicator being mountable on said first reservoir so as to close said first reservoir, wherein the length of said first reservoir is substantially equal to that of said bristled part, and wherein at least one part of the handle forms a secondary reservoir for a product to be stored and dispensed.

2. A packaging unit according to claim 1 wherein said secondary reservoir serves as a refill and has retaining means for preventing the product from flowing out.

3. A packaging unit according to claim 2 wherein said retaining means is a tearable cover.

4. A packaging unit according to claim 2 wherein said first reservoir and said secondary reservoir are symmetrical relative to the hinge.

5. A portable packaging unit for applying a liquid to pasty product onto keritanous fibers, comprising:

a first reservoir for a product to be stored and dispensed; and an applicator comprising a substantially planar handle made of two parts articulated at a hinge, and a bristled part directly fixed on said handle, said applicator being mountable on said first reservoir so as to close said first reservoir, wherein the length of said first reservoir is substantially equal to that of said bristled part, and wherein at least one part of the handle forms a secondary reservoir for product to be stored and dispensed, said secondary reservoir serving as a refill and having a retaining device configured to prevent the product from flowing out.

6. A packaging unit according to claim 5 wherein said retaining device is a tearable cover.

7. A portable packaging unit for applying a liquid to pasty product onto keratinous fibers, comprising:

a first reservoir for a product to be stored and dispensed;

an applicator comprising a substantially planar handle made of two parts articulated at a binge, and a bristled part having at least one tuft of bristles implanted parallel to the plane of the handle directly fixed on said handle, said applicator being mountable on said first reservoir so as to close said first reservoir, said first reservoir having a length substantially equal to that of said bristles;

a wiper for wiping the bristled part along the axis of the bristles; and a second reservoir forming a refill for replacing said first reservoir.

8. A portable packaging unit according to claim 7 wherein said second reservoir forms at least part of the substantially planar handle.

* * * * *

UNITED STATES PATENT AND TRADEMARK OFFICE

CERTIFICATE OF CORRECTION

PATENT NO. : 6,200,051 B1
DATED : March 13, 2001
INVENTOR(S) : Jean-Louis H. Gueret It is certified that error appears in the above-identified patent and that said Letters Patent is hereby corrected as shown below:

Column 6,
Line 31, change "binge" to -- hinge --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*